US008949073B2

(12) United States Patent
Nishino et al.

(10) Patent No.: US 8,949,073 B2
(45) Date of Patent: Feb. 3, 2015

(54) DIAGNOSTIC AID DEVICE

(75) Inventors: Atsushi Nishino, Kusatsu (JP); Satoshi Hashimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1026 days.

(21) Appl. No.: 13/058,872

(22) PCT Filed: Aug. 10, 2009

(86) PCT No.: PCT/JP2009/003835
§ 371 (c)(1),
(2), (4) Date: Feb. 14, 2011

(87) PCT Pub. No.: WO2010/021101
PCT Pub. Date: Feb. 25, 2010

(65) Prior Publication Data

US 2011/0144948 A1 Jun. 16, 2011

(30) Foreign Application Priority Data

Aug. 19, 2008 (JP) ..... 2008-210659

(51) Int. Cl.
*G06F 19/00* (2011.01)
*F24F 11/00* (2006.01)

(52) U.S. Cl.
CPC ..... *F24F 11/0086* (2013.01); *F24F 2011/0091* (2013.01)
USPC ..... 702/183

(58) Field of Classification Search
CPC ..... G06Q 50/06; H02J 3/14; F24F 2221/40; F24F 2011/0094; H05K 7/20754
USPC ..... 702/141, 117, 118, 182–185, 188
See application file for complete search history.

(56) References Cited

U.S. PATENT DOCUMENTS

2003/0192328 A1* 10/2003 Kikuchi et al. ..... 62/141
2008/0306632 A1 12/2008 Miki et al.

FOREIGN PATENT DOCUMENTS

CN 1553105 A 12/2004
JP 2002-335591 A 11/2002
JP 2004-085087 A 3/2004

(Continued)

OTHER PUBLICATIONS

International Preliminary Report of corresponding PCT Application No. PCT/JP2009/003835.

(Continued)

*Primary Examiner* — Edward Raymond
(74) *Attorney, Agent, or Firm* — Global IP Counselors

(57) ABSTRACT

A diagnostic aid device is configured to aid diagnosis of an operating efficiency of an air conditioner. The diagnostic aid device includes an obtaining section, a specifying section, a screen generating section and a measure information providing section. The obtaining section obtains an operating data of the air conditioner. Using the operating data obtained by the obtaining section, the specifying section specifies a state value of the air conditioner including air conditioning load factor, COP, power consumption or frequency. The screen generating section generates either a first screen or a second screen based on the state value specified by the specifying section. The first screen represents an operating status of the air conditioner. The second screen represents the operating status and single or plural sets of information related to a measure used to improve the state value.

17 Claims, 16 Drawing Sheets

(56) References Cited

FOREIGN PATENT DOCUMENTS

| | | | |
|---|---|---|---|
| JP | 2004-301505 | A | 10/2004 |
| JP | 2006-292279 | A | 10/2006 |
| KR | 10-2007-0045021 | A | 5/2007 |
| WO | WO 2008/084635 | A1 | 7/2008 |

OTHER PUBLICATIONS

International Search Report of corresponding PCT Application No. PCT/JP2009/003835.

* cited by examiner

ENTHALPY DIFFERENCE IN COOLING AND HEATING OPERATIONS (MOLLIER CHART)

| | CONDITION | | NEXT CONDITION | MEASURE |
|---|---|---|---|---|
| 1 | THE SYSTEM COP: LESS THAN OR EQUAL TO 60% OF THE RATED COP | □ | 2 | - |
| | | X | - | - |
| 2 | RATIO OF THE POWER CONSUMPTION UNDER A SYSTEM COP EQUAL TO 60 % OF THE RATED COP IN THE TOTAL POWER CONSUMPTION: GREATER THAN OR EQUAL TO 20 % | □ | 3 | - |
| | | X | - | - |
| 3 | A LOW COP OPERATION IS EXECUTED UNDER A LOAD FACTOR OF GREATER THAN OR EQUAL TO 90 % & THE POWER CONSUMPTION UNDER A LOW COP AND HIGH LOAD OPERATION IS GREATER THAN OR EQUAL TO 30 % OF THE TOTAL POWER CONSUMPTION UNDER A LOW COP OPERATION | □ | - | 1 |
| | | X | 4 | - |
| 4 | A LOW COP OPERATION IS EXECUTED UNDER A LOAD FACTOR OF LESS THAN OR EQUAL TO 30 % & THE POWER CONSUMPTION UNDER A LOW COP AND LOW LOAD OPERATION IS GREATER THAN OR EQUAL TO 30 % OF THE TOTAL POWER CONSUMPTION UNDER A LOW COP OPERATION | □ | 5 | - |
| | | X | - | - |
| 5 | THE ACTIVATION AND DEACTIVATION FREQUENCY: GREATER THAN OR EQUAL TO 5 TIMES / HOUR | □ | - | 2 |
| | | X | 6 | - |
| 6 | THE CONTINUOUS OPERATING TIME T0 IS GREATER THAN OR EQUAL TO T1 AND LESS THAN T2 ($T1 \leq T0 < T2$) | □ | - | 2 |
| | | X | 7 | - |
| 7 | THE CONTINUOUS OPERATING TIME T0 IS GREATER THAN OR EQUAL TO T2 ($T2 \leq T0$) | □ | - | 3 |
| | | X | - | - |

FIG. 4

| | CONTENTS OF MEASURE |
|---|---|
| 1 | INHIBITION OF THE UPPER LIMIT OF THE AIR CONDITIONING PERFORMANCE |
| 2 | TEMPERATURE RELIEF OF THE HEAT EXCHANGER (THE COOLING OPERATION: INCREASE IN EVAPORATION TEMPERATURE, THE HEATING OPERATION: REDUCTION IN CONDENSATION TEMPERATURE) |
| 3 | THE INTERMITTENT OPERATION (MANDATORY 3 MINUTES THERMO-OFF IN 30 MINUTES) |

FIG. 5

BAR CHART OF AIR CONDITIONING LOAD FACTOR (COOLING OPERATION)

TOTAL POWER CONSUMPTION FOR EACH AIR CONDITIONING LOAD FACTOR (COOLING OPERATION)

BAR CHART OF SYSTEM COP
(COOLING OPERATION)

TOTAL POWER CONSUMPTION FOR EACH SYSTEM COP
(COOLING OPERATION)

DIAGNOSTIC AID DEVICE

CROSS-REFERENCE TO RELATED APPLICATIONS

This U.S. National stage application claims priority under 35 U.S.C. §119(a) to Japanese Patent Application No. 2008-210659, filed in Japan on Aug. 19, 2008, the entire contents of which are hereby incorporated herein by reference.

TECHNICAL FIELD

The present invention relates to a diagnostic aid device for an air conditioner.

BACKGROUND ART

The air conditioners of the multi-units installation type are generally used in buildings such as office buildings, tenant buildings and the like for effectively regulating the air conditioning environment of the respective spaces within the buildings. It is estimated that percentage of the air-conditioner power consumption in the total power consumption of the buildings is now in an upward trend.

Meanwhile, in response to the recent demands for energy saving, as described in Japan Laid-open Patent Publication No. JP-A-2004-85087, devices configured to estimate the power consumption of an air conditioner for diagnosing the power consumption have been produced. The power consumption of the air conditioners of the multi-units installation type is greater than that of the air conditioners of a single-unit installation type. Therefore, an energy saving effect is expected to be achieved for the air conditioners of the multi-units installation type through any kind of countermeasure based on the estimation of the power consumption.

SUMMARY

Technical Problem

However, it is difficult to conclude that an energy saving effect is actually achieved in an air conditioner when the air conditioner shows an inefficient operating efficiency although the power consumption thereof is reduced. In other words, a highly power consuming air conditioner cannot be necessarily diagnosed as a wasteful air conditioner.

It is an object of the present invention to produce a diagnostic aid device for easily diagnosing the operating efficiency of an air conditioner in order to achieve an energy saving effect.

Solution to Problem

A diagnostic aid device according to a first aspect of the present invention is configured to aid diagnosis of an operating efficiency of an air conditioner. The diagnostic aid device includes an obtaining section, a specifying section and a screen generating section. The obtaining section is configured to obtain an operating data from the air conditioner. The specifying section is configured to specify a state value of the air conditioner using the operating data obtained by the obtaining section. The state value includes air conditioning load factor, COP, power consumption or frequency. The screen generating section is configured to generate either a first screen or a second screen based on the state value specified by the specifying section. The first screen represents an operating status of the air conditioner. The second screen represents the operating status and single or plural sets of information related to a measure for improving the state value.

According to the diagnostic aid device of the present invention, the operating data (evaporation pressure Pe, condensation pressure Pc an operating state of a compressor, and etc.) is obtained from the air conditioner. The state value of the air conditioner, including air conditioning load factor, COP, power consumption and frequency, is specified. Based on the state value, either the first screen or the second screen is generated. The operating status of the air conditioner is displayed on the first screen. The operating status and the single or plural sets of information related to a measure for improving the state value are displayed on the second screen.

Consequently, the operating efficiency of the air conditioner can be easily diagnosed and an energy saving effect can be thereby achieved.

A diagnostic aid device according to a second aspect of the present invention relates to the diagnostic aid device according to the first aspect of the present invention. The diagnostic aid device further includes a determining section and a measure information providing section. The determining section is configured to determine the operating efficiency based on the state value. The measure information providing section is configured to provide the screen generating section with the single or plural sets of information related to a measure for improving the state value. Further, the measure information providing section is configured to provide the screen generating section with the single or plural sets of information based on the operating efficiency determined by the determining section.

According to the diagnostic aid device of the present invention, the operating efficiency of the air conditioner is determined based on the state value. Further, the one or more information related to a measure for improving the state value is provided to the screen generating section based on the operating efficiency determined by the determining section.

Consequently, the operating efficiency of the air conditioner can be appropriately improved.

A diagnostic aid device according to a third aspect of the present invention relates to the diagnostic aid device according to the second aspect of the present invention. The diagnostic aid device further includes a determination condition storage area and a measure information storage area. The determination condition storage area is configured to store conditions to be used for determination of the operating efficiency by the determining section. The measure information storage area is configured to store the plural sets of information in accordance with the operating efficiency determined by the determining section.

According to the diagnostic aid device of the present invention, the operating efficiency of the air conditioner is determined based on the conditions stored in the determination condition storage area. Further, the plural sets of information are stored in the measure information storage area in accordance with the operating efficiency to be determined.

Consequently, an appropriate measure can be executed in accordance with the operating efficiency.

A diagnostic aid device according to a fourth aspect of the present invention relates to the diagnostic aid device according to the third aspect of the present invention. In the diagnostic aid device, the measure information providing section is configured to select one of the plural sets of information stored in the measure information storage area and provide the selected set of information to the screen generating section when the operating efficiency determined by the determining section is in a first state. Further, the screen generating section is configured to generate the second screen including the operating status of the air conditioner and the set of information provided thereto from the measure information providing section.

According to the diagnostic aid device of the present invention, the second screen is configured to be generated when the operating efficiency determined by the determining section is in the first state.

Consequently, it is possible to grasp that the operating efficiency of the air conditioner is in a predetermined state.

A diagnostic aid device according to a fifth aspect of the present invention relates to the diagnostic aid device according to the fourth aspect of the present invention. In the diagnostic aid device, the measure information providing section is configured to select suitable one of the plural sets of information and provide the selected set of information to the screen generating section when the determining section determines that the operating efficiency is inefficient.

According to the diagnostic aid device of the present invention, suitable one of the plural sets of information is selected for improving the operating efficiency when it is determined that the operating efficiency is inefficient, and the second screen is configured to be generated while including the selected set of information and the operating status of the air conditioner.

Consequently, an appropriate measure can be executed when the operating efficiency of the air conditioner is inefficient.

A diagnostic aid device according to a sixth aspect of the present invention relates to the diagnostic aid device according to the fifth aspect of the present invention. In the diagnostic aid device, the measure information providing section is configured to select suitable one of the plural sets of information in a case that the operating efficiency is inefficient. The case herein includes both of a situation that the COP is low and a situation that the power consumption is large.

According to the diagnostic aid device of the present invention, suitable one of the plural sets of information is selected for improving the operating efficiency when the COP is low and the power consumption is large, and the second screen is configured to be generated while including the selected set of information and the operating status of the air conditioner.

Consequently, both the coefficient of performance and the power consumption can be improved.

A diagnostic aid device according to a seventh aspect of the present invention relates to the diagnostic aid device according to the sixth aspect of the present invention. The diagnostic aid device further includes a load determining section. The load determining section is configured to determine in which cases the low COP situation occurs either when the air conditioner is under a high load or when the air conditioner is under a low load. Further, the measure information providing section is configured to select one of the plural sets of information in accordance with a result determined by the load determining section and provide the selected set of information to the screen generating section when the operating efficiency is inefficient.

According to the diagnostic aid device of the present invention, a measure suitable is selected for improving the operating efficiency in accordance with the magnitude of the load of the air conditioner under a low COP. Further, the second screen is displayed while including the selected measure and the operating status of the air conditioner.

Consequently, a suitable measure can be grasped in accordance with the magnitude of the load of the air conditioner.

A diagnostic aid device according to an eighth aspect of the present invention relates to the diagnostic aid device according to the seventh aspect of the present invention. The diagnostic aid device further includes an operating time determining section. The operating time determining section is configured to determine an operating time of the air conditioner based on the state value. The measure information providing section is further configured to select one of the plural sets of information in accordance with a result determined by the operating time determining section and provide the selected set of information to the screen providing section.

According to the diagnostic aid device of the present invention, the operating time of the air conditioner is further determined based on the state value. Further, one of the plural sets of information is selected in further consideration of the operating time of the air conditioner.

Consequently, it is possible to resolve reduction in the operating efficiency due to a long time operation or the like.

A diagnostic aid device according to a ninth aspect of the present invention relates to the diagnostic aid device according to one of the third to eighth aspects of the present invention. In the diagnostic aid device, the plural sets of information are proposals for the air conditioner respectively indicating air conditioning performance inhibition, target temperature change or intermittent operation execution.

According to the diagnostic aid device of the present invention, a given set of information is selected from the plural sets of information proposing air conditioning performance inhibition, target temperature change and intermittent operation execution to the air conditioner in accordance with the operating efficiency of the air conditioner, and the second screen is configured to be generated.

Consequently, the operating efficiency of the air conditioner can be enhanced.

A diagnostic aid device according to a tenth aspect of the present invention relates to the diagnostic aid device according to the fourth aspect of the present invention. The diagnostic aid device further includes a control command generating section. The control command generating section is configured to generate a control command in accordance with the set of information selected by the measure information providing section. The control command is herein a command for controlling the air conditioner.

According to the diagnostic aid device of the present invention, a control command is configured to be generated in accordance with the set of information to be selected in accordance with the operating efficiency.

Consequently, a suitable control can be automatically executed for improving the operating efficiency.

A diagnostic aid device according to an eleventh aspect of the present invention relates to the diagnostic aid device according to the first aspect of the present invention. In the diagnostic aid device, the screen generating section is configured to generate either the first screen or the second screen for displaying the operating status determined based on a relation between a given single state value and each of the other plural state values.

According to the diagnostic aid device of the present invention, either the first screen or the second screen is configured to be generated for displaying the operating status determined based on the relation between a given single state value and each of the other plural of state values.

Consequently, the operating efficiency can be easily diagnosed.

A diagnostic aid device according to a twelfth aspect of the present invention relates to the diagnostic aid device according to the eleventh aspect of the present invention. In the diagnostic aid device, the first screen or the second screen to be generated by the screen generating section includes a third screen and a fourth screen. The third screen is configured to display an operating status determined based on a relation between a first state value and a second state value. The first state value corresponds to the given single state value, whereas the second state value is different from the first state value. The fourth screen is configured to display an operating status determined based on a relation between the first state value and a third state value. The third state value is different from both of the first state value and the second state value.

According to the diagnostic aid device of the present invention, the first screen or the second screen includes the third screen and the fourth screen. The operating status determined based on the relation between the first state value and the second state value is displayed on the third screen. The first state value corresponds to the given single state value, whereas the second state value is a state value different from the first state value. On the other hand, the operating status determined based on the relation between the first state value and the third state value is displayed on the fourth screen. The third state value is a state value different from both of the first state value and the second state value.

Consequently, plural determination results can be checked, which are determined based on the relations between a common state value and different state values.

A diagnostic aid device according to a thirteenth aspect of the present invention relates to the diagnostic aid device according to the twelfth aspect of the present invention. In the diagnostic aid device, the operating status is displayed on each of the third screen and the fourth screen in a bar chart format.

According to the diagnostic aid device of the present invention, the operating status determined based on the relation among the state values is displayed on each of the third screen and the fourth screen in a bar chart format.

Consequently, the operating status of the air conditioner can be easily checked in a predetermined term.

A diagnostic aid device according to a fourteenth aspect of the present invention relates to the diagnostic aid device according to one of the twelfth and thirteenth aspects of the present invention. In the diagnostic aid device, the first state value indicates the air conditioning load factor, the second state value indicates the frequency, and the third state value indicates the power consumption.

According to the diagnostic aid device of the present invention, the screens respectively display a chart of the operating status determined based on the relation between the air conditioning load factor and the frequency and a chart of the operating status determined based on the relation between the air conditioning load factor and the power consumption.

Consequently, the operating efficiency can be assessed by comparing the air conditioning load factor and the frequency.

A diagnostic aid device according to a fifteenth aspect of the present invention relates to the diagnostic aid device according to one of the twelfth and thirteenth aspects of the present invention. In the diagnostic aid device, the first state value indicates the COP, the second state value indicates the frequency, and the third state value indicates the power consumption.

According to the diagnostic aid device of the present invention, the screens respectively display a chart of the operating status determined based on the relation between the COP and the frequency and a chart of the operating status determined based on the relation between the COP and the power consumption.

Consequently, the operating efficiency can be assessed by comparing the frequency and the power consumption.

Advantageous Effects of Invention

According to the diagnostic aid device of the first aspect of the present invention, the operating efficiency of the air conditioner can be easily diagnosed and an energy saving effect can be thereby achieved.

According to the diagnostic aid device of the second aspect of the present invention, the operating efficiency of the air conditioner can be appropriately improved.

According to the diagnostic aid device of the third aspect of the present invention, an appropriate measure can be executed in accordance with the operating efficiency.

According to the diagnostic aid device of the fourth aspect of the present invention, it is possible to grasp that the operating efficiency of the air conditioner is in a predetermined state.

According to the diagnostic aid device of the fifth aspect of the present invention, an appropriate measure can be executed when the operating efficiency of the air conditioner is inefficient.

According to the diagnostic aid device of the sixth aspect of the present invention, both the coefficient of performance and the power consumption can be improved.

According to the diagnostic aid device of the seventh aspect of the present invention, a suitable measure can be grasped in accordance with the magnitude of the load of the air conditioner.

According to the diagnostic aid device of the eighth aspect of the present invention, it is possible to resolve reduction in the operating efficiency due to a long time operation or the like.

According to the diagnostic aid device of the ninth aspect of the present invention, the operating efficiency of the air conditioner can be enhanced.

According to the diagnostic aid device of the tenth aspect of the present invention, a suitable control can be automatically executed for improving the operating efficiency.

According to the diagnostic aid device of the eleventh aspect of the present invention, the operating efficiency can be easily diagnosed.

According to the diagnostic aid device of the twelfth aspect of the present invention, plural determination results can be checked, which are determined based on the relations between a common state value and different state values.

According to the diagnostic aid device of the thirteenth aspect of the present invention, the operating status of the air conditioner can be easily checked in a predetermined term.

According to the diagnostic aid device of the fourteenth aspect of the present invention, the operating efficiency can be assessed by comparing the air conditioning load factor and the frequency.

According to the diagnostic aid device of the fifteenth aspect of the present invention, the operating efficiency can be assessed by comparing the frequency and the power consumption.

BRIEF DESCRIPTION OF THE DRAWINGS

FIG. 4 is a table representing determination conditions stored in a determination condition storage area.

FIG. 5 is a table representing plural sets of measure information stored in a measure information storage area.

DESCRIPTION OF EMBODIMENTS

A diagnostic aid system 1 for an air conditioner according to the present invention will be hereinafter explained with reference to figures.

(1) Entire Configuration

Figure 1:
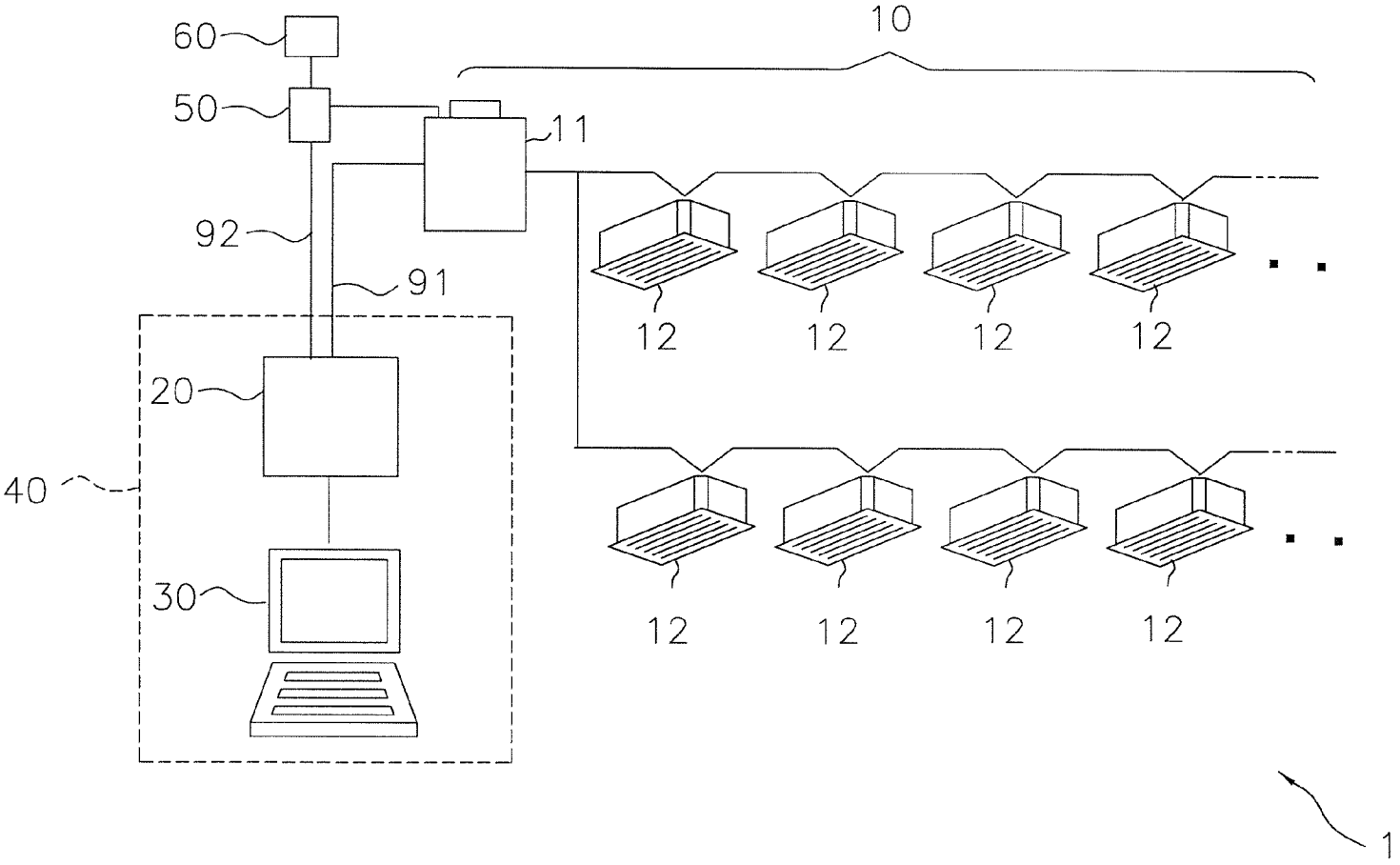
FIG. 1 is a diagram illustrating the entire configuration of a diagnostic aid system according to an exemplary embodiment of the present invention.

FIG. 1 illustrates the configuration of the diagnostic aid system 1 for an air conditioner 10 to be used in the present exemplary embodiment. The diagnostic aid system 1 is a system used for buildings such as office buildings, tenant buildings and the like. The diagnostic aid system 1 mainly includes the air conditioner 10 and a diagnostic aid device 40.

The air conditioner 10 is an air conditioner of a multi-units installation type that a plurality of indoor units 12 is connected to a single outdoor unit 11. FIG. 1 illustrates the air conditioner 10 including the single outdoor unit 11 and eight indoor units 12. However, the number of the outdoor unit 11 and the number of the indoor units 12 are not limited to the above configuration.

The diagnostic aid device 40 includes a Controller 20 and an auxiliary device 30. The controller 20 is connected to the outdoor unit 11 through an air conditioning control dedicated communication line 91. The controller 20 is configured to transmit a control command for the air conditioner 10 to the outdoor unit 11 through the air conditioning control dedicated communication line 91. Further, the controller 20 is configured to obtain an operating data of the air conditioner 10 through the air conditioning control dedicated communication line 91. The term "operating data" herein refers to the data related to the operating history of the air conditioner 10 and the data related to the operating state of the air conditioner 10. Further, the term "data related to the operating history" refers to information regarding a power on/off state, a thermo-on/off state, an operating mode (cooling mode, heating mode, ventilation mode, etc.), a temperature setting, an indoor temperature (inhalation temperatures) and the like for each indoor unit 12. The term "data related to the operating state" refers to values detected by a variety of sensors and meters attached to the air conditioner 10. Through the operating data obtained from the air conditioner 10, the controller 20 is allowed to determine, for instance, the operating time, the opening degree of an indoor expansion valve, the evaporating pressure Pe, the condensation pressure Pc, the frequency/rotation speed of a compressor, and the like for each indoor unit 12. It should be noted that the term "operating time" in the present exemplary embodiment specifically refers to a thereto-on time of each indoor unit 12. Further, the term "thermo-on time" refers to a period of time when each indoor unit 12 conducts heating and cooling supply.

Further in the diagnostic aid system 1, a wattmeter 50 is configured to measure electric power to be supplied to the air conditioner 10 from a power supply 60. Specifically, the outdoor unit 11 is connected to the power supply 60, and the wattmeter 50 is installed between the power supply 60 and the outdoor unit 11. The wattmeter 50 is configured to measure the amount of electric power supplied to the outdoor unit 11 from the power supply 60. The controller 20 is configured to obtain, through a wiring 92, the amount of electric power measured by the wattmeter 50, i.e., information of electric power supplied to the outdoor unit 11 for operating the air conditioner 10 (total power consumption). The power consumption measured by the wattmeter 50 is stored as the operating data of the air conditioner 10 in an operating data storage area 24*a* to be described.

(2) Diagnostic Aid Device Configuration

Figure 2:
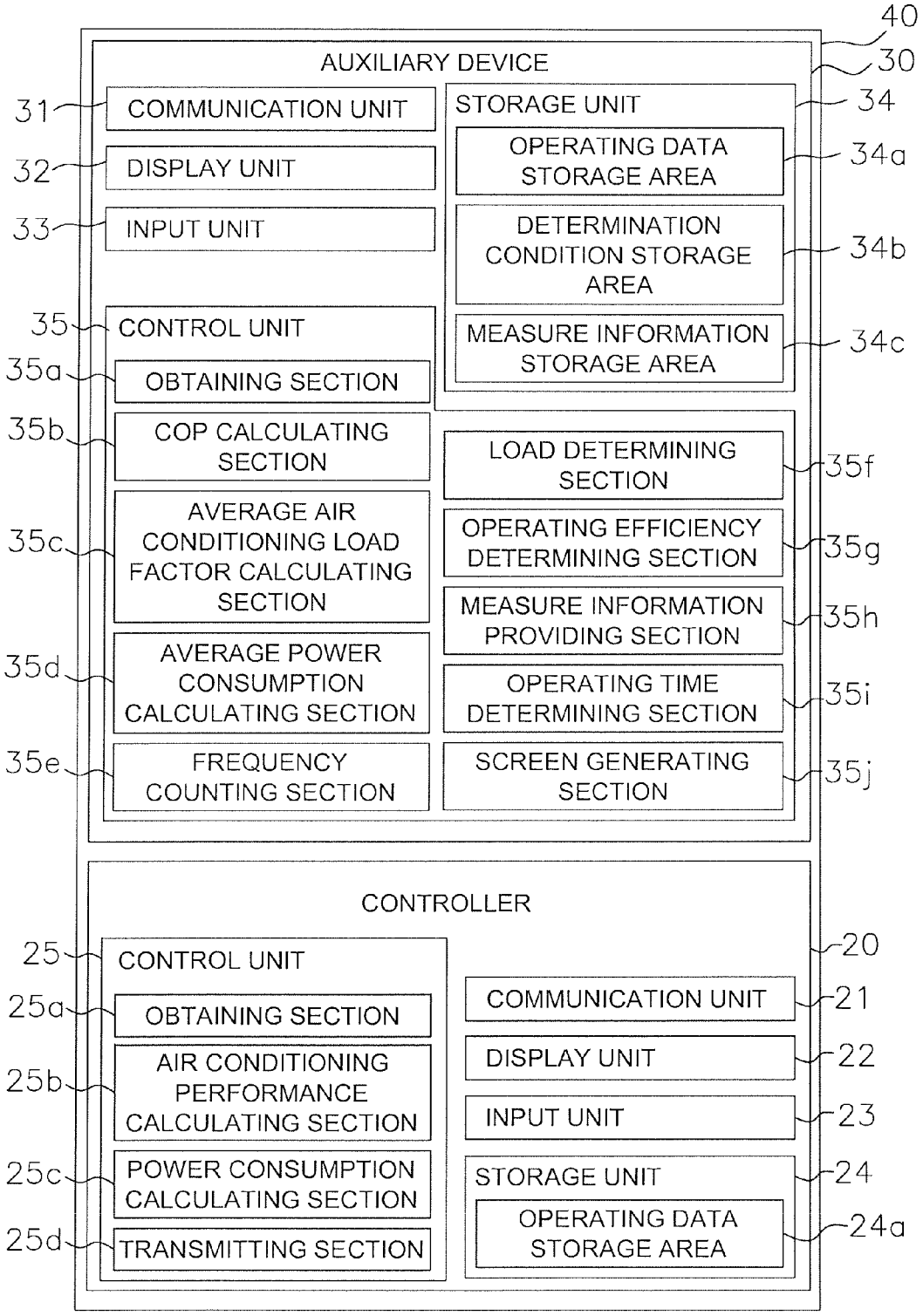
FIG. 2 is a diagram illustrating the configuration of a diagnostic aid device according to the present exemplary embodiment.

FIG. 2 is a schematic configuration diagram of the diagnostic aid device 40 according to the present exemplary embodiment. The diagnostic aid device 40 includes the controller 20 and the auxiliary device 30. As described above, the controller 20 is connected to the outdoor unit 11 of the air conditioner 10 through the air conditioning control dedicated communication line 91. Further, the auxiliary device 30 is connected to the controller 20 through a LAN. The auxiliary device 30 is configured to obtain the operating data of the air conditioner 10 through the controller 20. The configurations of the respective components of the diagnostic aid device 40 will be hereinafter explained with reference to FIG. 2.

(2-1) Controller

The controller 20 mainly includes a communication unit 21, a display unit 22, an input unit 23, a storage unit 24 and a control unit 25.

[Communication Unit]

The communication unit 21 is a communication interface for communicating with external devices.

[Display Unit]

The display unit 22 is a display for displaying the operating data of the respective indoor units 12 received by the controller 20. The operating data to be displayed on this display include the activation/deactivation state, the operating mode (the cooling mode, the heating mode, the ventilation mode and etc.), the temperature setting, the indoor temperature and the like for each indoor unit 12. Further, the display unit 22 functions as an operational screen for receiving a control command/commands with respect to the plural indoor units 12.

[Input Unit]

The input unit 23 mainly includes a touch panel covering the aforementioned display and operational keys.

[Storage Unit]

The storage unit 24 includes the operating data storage area 24*a*. The operating data storage area 24*a* stores the operating data of the air conditioner 10. The operating data to be stored in the operating data storage area 24*a* include the data related to the operating history of the air conditioner 10, the data related to the operating state of the air conditioner 10, and the power consumption of the air conditioner 10. The power consumption of the air conditioner 10 herein includes the total power consumption obtained by an obtaining section 25*a* to be described, power consumption of the outdoor unit 11 (outdoor unit power consumption $E_O$) calculated by a power consumption calculating section 25*c* to be described, and the power consumptions of the indoor units 12 (indoor unit power consumptions $E_{IK}$). It should be noted that the operating data storage area 24*a* has a storage capacity allowed to store the operating data for a predetermined period of time (30 minutes in the present exemplary embodiment). Every time a new operating data is obtained, an older operating data is sequentially erased. It should be noted that the storage unit 24 includes an area for storing a management program readable and executable by the control unit 25 to be described in addition to the aforementioned area.

[Control Unit]

The control unit 25 mainly includes the obtaining section 25*a*, an air conditioning performance calculating section 25*b*, the power consumption calculating section 25*c* and a transmitting section 25*d*.

(a) Obtaining Section

The obtaining section 25*a* is configured to obtain the operating data of the air conditioner 10 through the communication unit 21 at predetermined time intervals (every five minutes in the present exemplary embodiment).

(b) Air Conditioning Performance Calculating Section

The air conditioning performance calculating section 25*b* is configured to calculate the air conditioning performance of the air conditioner 10 based on the operating data of the air conditioner 10 obtained by the obtaining section 25*a*. Specifically, the air conditioning performance calculating section 25*b* is configured to calculate the air conditioning performance by multiplying an enthalpy difference of an evaporator or condenser by a refrigerant circulation amount G. More specifically, an air conditioning performance Qc in a cooling performance is calculated by multiplying an enthalpy difference Δic of the evaporator by the refrigerant circulation amount G ($Qc=\Delta ic\times G$). On the other hand, an air conditioning performance Qh in a heating operation is calculated by multiplying an enthalpy difference Δih of a condenser by the refrigerant circulation amount G ($Qh=\Delta ih\times G$).

It should be noted that the air conditioning performance calculating section 25*b* is configured to calculate the enthalpy differences Δic and Δih herein used, and the refrigerant circulation amount G based on the operating data obtained by the obtaining section 25*a*. Specifically, the enthalpy differences Δic and Δih are calculated based on the evaporation pressure Pe, the condensation pressure Pc, the performance property of the compressor, and a control target value (a super heating temperature SH, a super cooling temperature SC).

Figure 3:
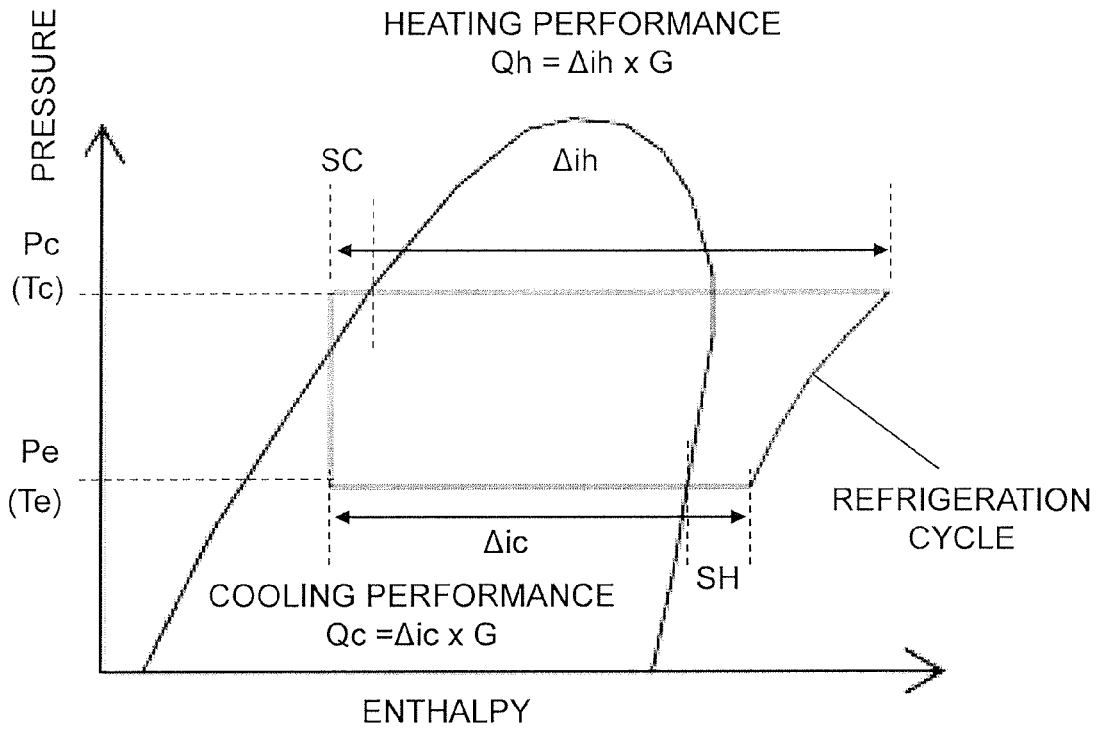
FIG. 3 is a chart representing the enthalpy difference between a cooling operation and a heating operation.

FIG. 3 is a chart representing enthalpy differences in cooling and heating operations, and represents the relation of the aforementioned operating data. Further, the refrigerant circulation amount G is calculated based on an evaporation-pressure corresponding saturation temperature Te and a condensation-pressure corresponding saturation temperature Tc (i.e., G=f (Te, Tc)) (see ARI: STANDARD for PERFORMANCE RATION OF POSITIVE DISPLACEMANT REFRIGERANT COMPRESSORS AND COMPRESSOR UNITS, Standard 540 (2004), Carl C. Hiller: DETAILED MODELING AND COMPUTER SIMULATION OF RECIPROCATING REFRIGERATION COMPRESSORS, Proc. of International Compressor Engineering Conference at Purdue (1976), pp 12-16). It should be noted that the evaporation-pressure corresponding saturation temperature Te is a variable uniquely specified by the evaporation pressure Pe, whereas the condensation-pressure corresponding saturation temperature Tc is a variable uniquely specified by the condensation pressure Pc.

(c) Power Consumption Calculating Section

The power consumption calculating section 25*c* is configured to calculate the power consumption of the air conditioner 10. Specifically, the power consumption calculating section 25*c* is configured to calculate the outdoor unit power consumption $E_O$ (i.e., the power consumption of each outdoor unit 11) and the indoor unit power consumptions $E_{IK}$ (i.e., the power consumptions of the indoor units 12), respectively, based on the total power consumption stored in the operating data storage area 24*a*. The outdoor unit power consumption $E_O$ is calculated by proportionally dividing the power consumption measured by the wattmeter 50 in accordance with the performance ratio of the outdoor unit/units 11 included in the diagnostic aid system 1. In other words, the power consumption measured by the wattmeter 50 corresponds to the outdoor unit power consumption $E_O$ when a single outdoor unit 11 is included in the diagnostic aid system 1. The indoor unit power consumptions $E_{IK}$ are calculated by multiplying the rated power of fans embedded in the indoor units 12 by operating time of the indoor units 12. The values calculated by the power consumption calculating section 25*c* are stored in the aforementioned operating data storage area 24*a*.

(d) Transmitting Section

The transmitting section 25*d* is configured to transmit the operating data stored in the operating data storage area 24*a* to the auxiliary device 30 through the communication unit 21 at predetermined time intervals (e.g., every five minutes).

(2-2) Auxiliary Device Configuration

As illustrated in FIG. 2, the auxiliary device 30 mainly includes a communication unit 31, a display unit 32, an input unit 33, a storage unit 34 and a control unit 35.

[Communication Unit]

The communication unit 31 is a communication interface for communicating with the controller 20.

[Display Unit]

The display unit 32 is a display for displaying the operating data of the air conditioner 10 obtained through the controller 20. Similarly to the operating data displayed on the display unit 22 of the controller 20, the operating data to be displayed on this display includes the activation/deactivation state, the operational mode (the cooling mode, the heating mode, the ventilation mode and etc.), the temperature setting, the indoor temperature and the like for each indoor unit 12. Further, the display unit 32 is configured to display a screen to be generated by a screen generating section 35*j* to be described. The screen to be generated by the screen generating section 35*j* will be explained in detail together with explanation of the screen generating section 35*j*.

[Input Unit]

The input unit 33 mainly includes a keyboard and operational keys.

[Storage Unit]

The storage unit 34 mainly includes an operating data storage area 34*a*, a determination condition storage area 34*b* and a measure information storage area 34*c*.

(a) Operating Data Storage Area

The operating data storage area 34*a* stores the operating data transmitted by the aforementioned transmitting section 25*d* (i.e., the data related to operating histories of the air conditioner 10, the data related to the operating states of the air conditioner 10, the outdoor unit power consumption $E_O$ and the indoor unit power consumptions $E_{IK}$). Further, the operating data storage area 34*a* stores values obtained by a COP calculating section 35*c*, an average air conditioning load factor calculating section 35*c*, an average power consumption calculating section 35*d* and a frequency counting section 35*e* to be described. The values stored in the operating data storage area 34*a* will be hereinafter explained as state values of the indoor units.

(b) Determination Condition Storage Area

The determination condition storage area 34*b* stores a plurality of conditions to be used for determining an operating efficiency of the air conditioner 10 (i.e., determination conditions). FIG. 4 represents exemplary determination conditions. Each determination condition is associated with a numerical value of either the next condition or measure information depending on whether or not the condition is satisfied. The next condition refers to a condition to be determined after determination of the current condition. The numerical value of the measure information refers to a numerical value corresponding to the information stored in the measure information storage area 34*c* to be described. An appropriate determination condition is used in accordance with an operating efficiency to be determined by an operating efficiency determination section 35*g*.

(c) Measure Information Storage Area

The measure information storage area 34*c* stores information related to measures for improving the operating efficiency (i.e., measure information). Specifically, a plurality of measures is stored as the measure information in accordance with an extent of the operating efficiency (i.e., magnitude of each state value).

[Control Unit]

The control unit 35 mainly includes an obtaining section 35*a*, the COP calculating section 35*b*, the average air conditioning load factor calculating section 35*c*, the average power consumption calculating section 35*d*, the frequency counting section 35*e*, a load determining section 35*f*, the operating efficiency determining section 35*g*, a measure information providing section 35*h*, an operating time determining section 35*i* and the screen generating section 35*j*.

(a) Obtaining Section

The obtaining section 35*a* is configured to obtain the operating data transmitted from the aforementioned controller 20.

(b) COP Calculating Section

The COP calculating section 35*b* is configured to calculate COPs (coefficients of performance) of the air conditioner 10. The COPs of the air conditioner 10 include a device COP and a system COP. The device COP indicates the performance of a single outdoor unit 11. Specifically, the device COP is set as a value calculated by dividing an air conditioning performance Q of the outdoor unit 11 calculated by the aforementioned air conditioning performance calculating section 25*b* by the power consumption $E_O$ of the outdoor unit 11 (i.e., device COP=$Q/E_O$). The system COP is set as a value calculated by dividing the air conditioning performance Q by addition of the outdoor unit power consumption $E_O$ and sum of the indoor unit power consumptions $E_{IK}$. (system COP=$Q/(E_O+\Sigma E_{IK})$. The system COP is calculated for each refrigerant system. Further, the system COP in a predetermined term is obtained by the equation "system COP=$(\Sigma Qc/\Sigma H)/Ea$". In the equation, $\Sigma H$ represents an operating time [hour] of the air conditioner 10. In the present exemplary embodiment, the predetermined term is set to be one day. The COPs calculated by the COP calculating section 35*b* are stored in the operating data storage area 34*a*.

(c) Average Air Conditioning Load Factor Calculating Section

The average air conditioning load factor calculating section 35*c* is configured to calculate average per day of the air conditioning load factor of the air conditioner 10 in a predetermined term based on the operating data stored in the operating data storage area 34*a*. Specifically, the average per day of the air conditioning load factor is obtained by the equation "air conditioning load factor [%]=$(\Sigma Qc/\Sigma H)/Qr$". In the equation, Qr represents a rated performance [kW]. The average per day of the air conditioning load factor, calculated by the average air conditioning load factor calculating section 35*c*, is stored in the operating data storage area 34*a*.

(d) Average Power Consumption Calculating Section

The average power consumption calculating section 35*d* is configured to calculate average per day of the total power consumption of the air conditioner 10 in a predetermined term based on the operating data stored in the operating data storage area 34*a*. Specifically, the average per day of the total power consumption is calculated by the equation "power consumption Ea [kWh/h]=$\Sigma(E_O+\Sigma E_{IK})/\Sigma H$". The average per day of the total power consumption, calculated by the average power consumption calculating section 35*d*, is stored in the operating data storage area 34*a*.

(e) Frequency counting Section

The frequency counting section 35*e* is configured to count the frequency (the number of occurrences) regarding that the air conditioning load factor of the air conditioner 10 is equal to a predetermined average air conditioning load factor in the aforementioned predetermined term (e.g., three days are counted as the number of days when the air conditioning load factor is equal to 0%) and the frequency regarding that the system COP is equal to a predetermined value in the aforementioned predetermined term (e.g., three days are counted as the number of days when the system COP is equal to 0). The frequencies counted by the frequency counting section 35*e* are stored in the operating data storage area 34*a*.

(f) Load Determining Section

The load determining section 35*f* is configured to determine in which of the following cases a condition of a low system COP occurs more: a case of a high air conditioning load (high lad); or a case of a low air conditioning load (low load). The condition of a low system COP (i.e., low COP condition) refers to a condition that the system COP is less than or equal to 60% of the rated COP. The load determining section 35*f* is configured to execute the aforementioned determination based on the average per day of the air conditioning load factor stored in the operating data storage area 34*a*.

(g) Operating Efficiency Determining Section

The operating efficiency determining section 35*g* is configured to determine an operating efficiency of the air conditioner 10 based on the operating data stored in the operating data storage area 34*a* and the determination conditions stored in the determination condition storage area 34*b*. The method of determining an operating coefficient by the operating efficiency determining section 35*g* will be explained in detail in the following section "(4) Processing Flow".

(h) Measure Information Providing Section

The measure information providing section 35*h* is configured to select a single measure information set matched with the determination result by the operating efficiency determining section 35*g* from the plural measure information sets stored in the aforementioned measure information storage area 34*c*. Subsequently, the measure information providing section 35*h* is configured to provide the selected measure information set to the screen generating section 35*j* to be described.

(i) Operating Time Determining Section

The operating time determining section 35*i* is configured to determine the operating time of each indoor unit 12 based on the operating data stored in the operating data storage area 34*a*.

(j) Screen Generating Section

Figure 6A:
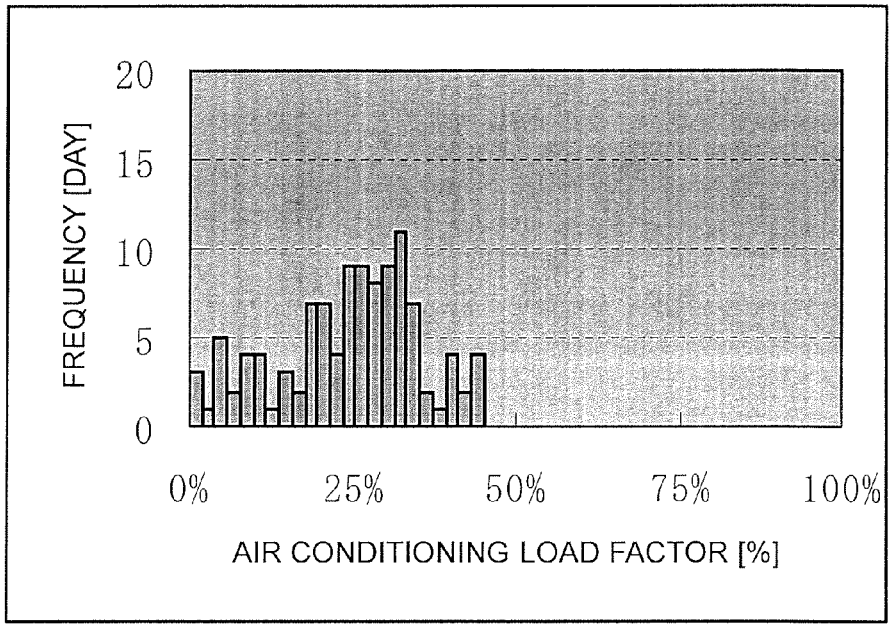
FIG. 6A is an exemplary screen to be displayed on a display unit according to the present exemplary embodiment.
Figure 6B:
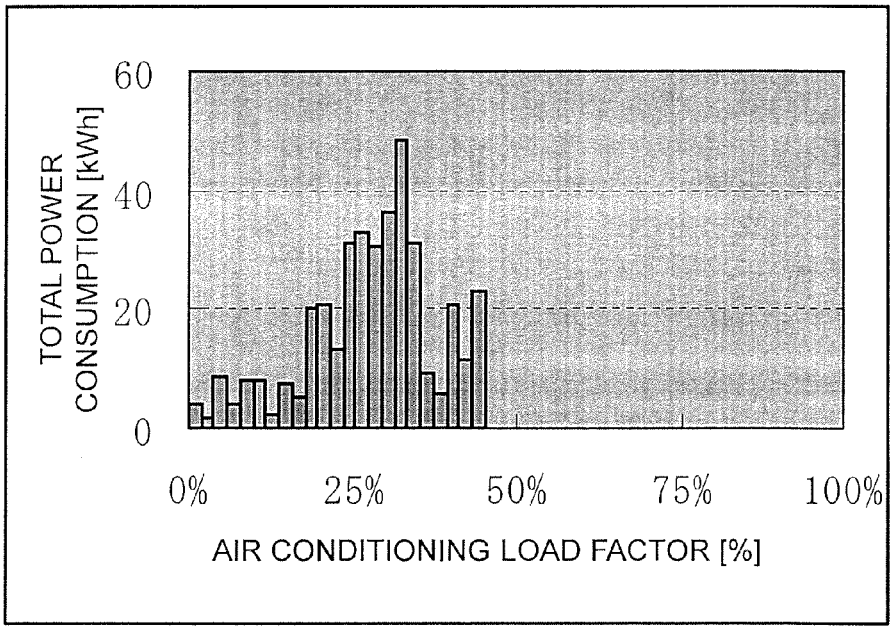
FIG. 6B is an exemplary screen to be displayed on the display unit according to the present exemplary embodiment.
Figure 6C:
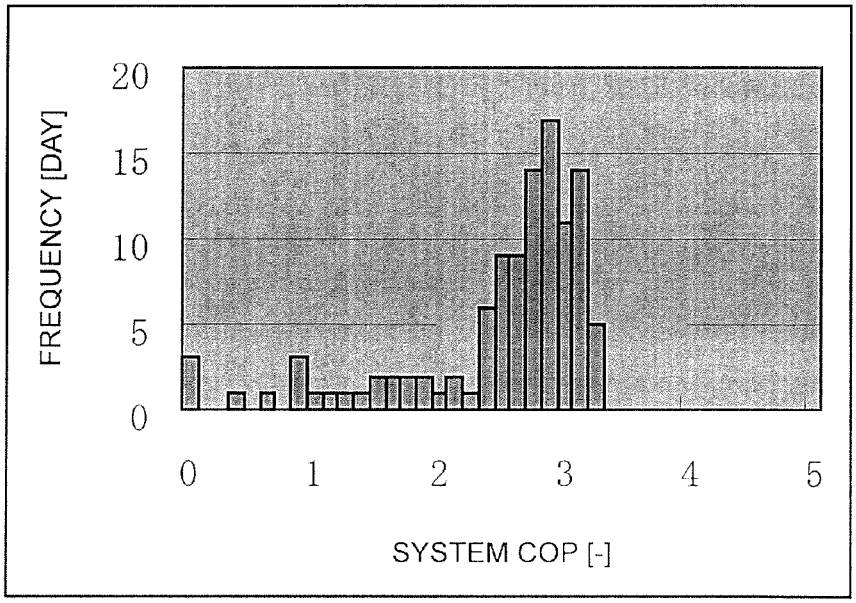
FIG. 6C is an exemplary screen to be displayed on the display unit according to the present exemplary embodiment.
Figure 6D:
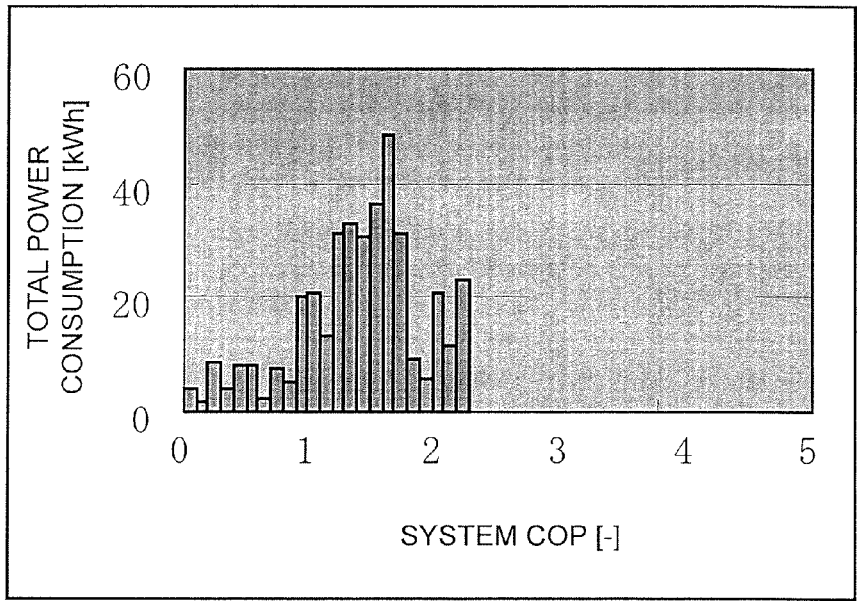
FIG. 6D is an exemplary screen to be displayed on the display unit according to the present exemplary embodiment.
Figure 7:
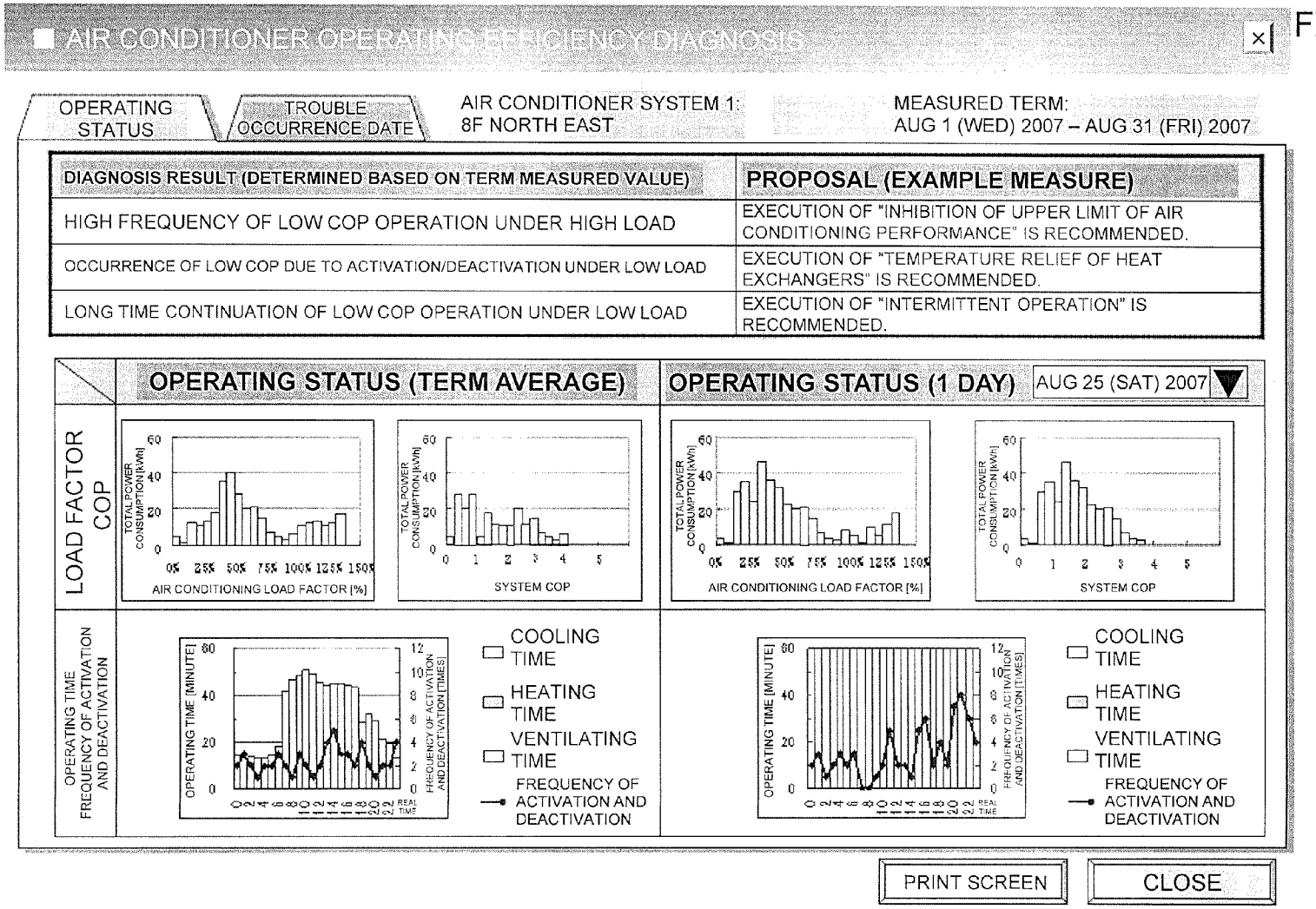
FIG. 7 is an exemplary operating efficiency diagnosis screen generated by a screen generating section.

The screen generating section 35*j* is configured to generate a screen (first screen) displaying an operating status of the air conditioner 10 in a predetermined term (see FIGS. 6A to 7). The operating data related to the plural indoor units 12 is displayed for each refrigerant system on the screen. In particular, bar charts are displayed on the screen for representing state values (i.e., the frequency, the air conditioning load factor, the total power consumption and the system COP) of the plural indoor units 12. Specifically, a screen illustrated in FIG. 6A is a type of screen representing an operating status of the air conditioner 10 determined based on the aforementioned value calculated by the average air conditioning load factor calculating section 35*c* and the aforementioned frequency counted by the frequency counting section 35*e* regarding that the air conditioning load factor of the air conditioner 10 is equal to a predetermined average air conditioning load factor. A screen illustrated in FIG. 6B is a type of screen representing an operating status of the air conditioner 10 determined based on the aforementioned value calculated by the average air conditioning load factor calculating section 35*c* and the aforementioned average per day of the total power consumption calculated by the average power consumption calculating section 35*d*. Further, a screen illustrated in FIG. 6C is a type of screen representing an operating status of the air conditioner 10 determined based on the aforementioned value calculated by the COP calculating section 35*b* and the aforementioned frequency counted by the frequency counting section 35*e* regarding that the COP of the air conditioner 10 is equal to a predetermined value. Yet further, a screen illustrated by FIG. 6D is a type of screen representing an operating status of the air conditioner 10 determined based on the aforementioned value calculated by the COP calculating section 35*b* and the aforementioned average per day of the total power consumption calculated by the average power consumption calculating section 35*d*.

In a predetermined case, the screen generating section 35*j* is configured to further generate a screen displaying the measure information (second screen) in addition to the operating status of the air conditioner 10 in a predetermined term. The measure information is the aforementioned information provided by the measure information providing section 35*h*. The predetermined case refers to the case that the operating efficiency of the air conditioner 10, determined by the operating efficiency determining section 35*g*, is inefficient. FIG. 7 is an exemplary screen displaying the measure information provided by the measure information providing section 35*h*.

(3) Explanation of Screen

Screens displaying the operating status of the air conditioner 10 will be hereinafter explained with reference to FIGS. 6A to 6D. The screens are generated by the screen generating section 35*j*. As described above, FIGS. 6A to 6D illustrate the screens to be displayed by the display unit 32 of the auxiliary device 30. The screen illustrated in FIG. 6A is a bar chart of the air conditioning load factor where the horizontal axis represents the air conditioning load factor [%] of the air conditioner 10 and the vertical axis represents the frequency regarding that the air conditioner 10 is operated under a predetermined air conditioning load factor. The screen illustrated in FIG. 6B is a bar chart of the total power consumption at each air conditioning load factor where the horizontal axis represents the air conditioning load factor [%] of the air conditioner 10 and the vertical axis represents the total power consumption [kWh] of the air conditioner 10. The screen illustrated in FIG. 6C is a bar chart of the system COP where the horizontal axis represents the system COP [-] of the air conditioner 10 and the vertical axis represents the frequency regarding that the system COP of the air conditioner 10 is equal to a predetermined value. The screen illustrated in FIG. 6D is a bar chart of the total power consumption at each system COP where the horizontal axis represents the system COP [-] of the air conditioner 10 and the vertical axis represents the total power consumption [kWh] of the air conditioner 10.

(4) Processing Flow

Figure 8:
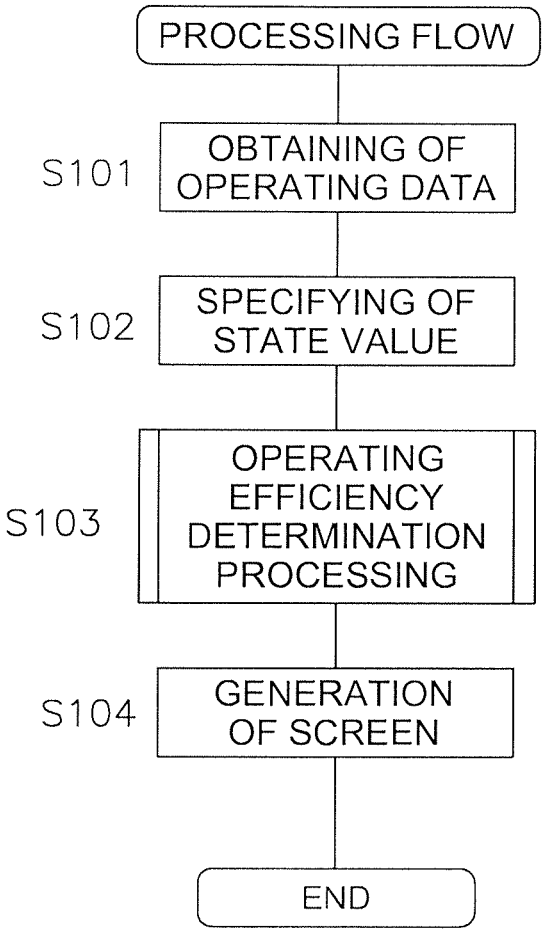
FIG. 8 is a flowchart representing the flow of a screen generation processing to be executed by the diagnostic aid device according to the present exemplary embodiment.
Figure 9:
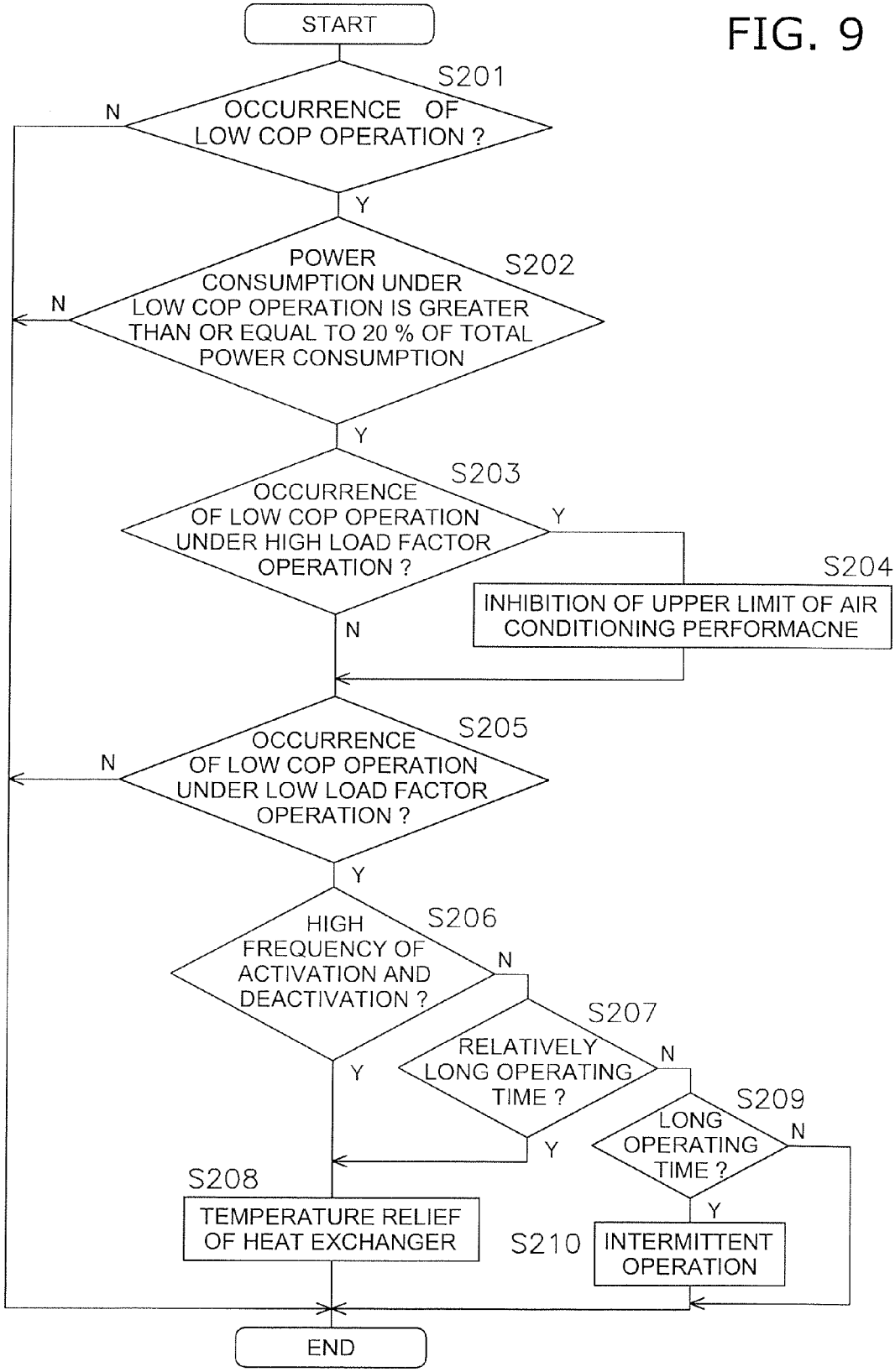
FIG. 9 is a flowchart representing the flow of an operating efficiency determination processing to be executed by the diagnostic aid device according to the present exemplary embodiment.

The following explanation, with reference to FIGS. 8 and 9, relates to a series of flow of a processing ended with display of the operating status of the air conditioner 10 (i.e., plural indoor units 12 included in a single refrigerant system) and the information for improving the operating efficiency of the air conditioner 10 on the display unit 32.

[Screen Generation Processing]

In Step S101, the auxiliary device 30 obtains the operating data of the air conditioner 10 through the controller 20. Specifically, the obtaining section 35*a* obtains the operating data stored in the operating data storage area 24*a* of the controller 20. Subsequently in Step S102, state values of the air conditioner 10 are specified. Specifically, the state values are the air conditioning load factor, the power consumption, the system COP, the frequency and the like of the air conditioner 10. As described above, the values are calculated by the COP calculating section 35*b*, the average air conditioning load factor calculating section 35*c*, the average power consumption calculating section 35*d* and the frequency counting section 35*e*. Next, the processing proceeds to Step S103 and an operating efficiency determination processing is executed. The operating efficiency determination processing will be explained below.

Subsequently in Step S104, screens to be displayed on the display unit 32 are generated. Specifically, the following combinations of screens are displayed: a combination of a screen displaying a bar chart determined by the relation between the air conditioning load factor and the frequency (see FIG. 6A) and a screen displaying a bar chart determined by the relation between the air conditioning load factor and the total power consumption (see FIG. 6B); a combination of a screen displaying a bar chart determined by the relation between the system COP and the frequency (see FIG. 6C) and a screen displaying a bar chart determined by the relation between the system COP and the total power consumption (see FIG. 6D); and/or a combination of a screen displaying a bar chart determined by the relation between the air conditioning load factor and the total power consumption (see FIG. 6B) and a screen displaying a bar chart determined by the relation between the system COP and the total power consumption (see FIG. 6D). In the aforementioned screens, the measure information provided by the measure information providing section 35*h* is also displayed. The screens are displayed on the display unit 32.

[Operating Efficiency Determination Processing]

The following explanation, with reference to FIG. 9, relates to a processing that the operating efficiency determining section 35*g* determines the operating efficiency of the air conditioner 10.

Figure 10:
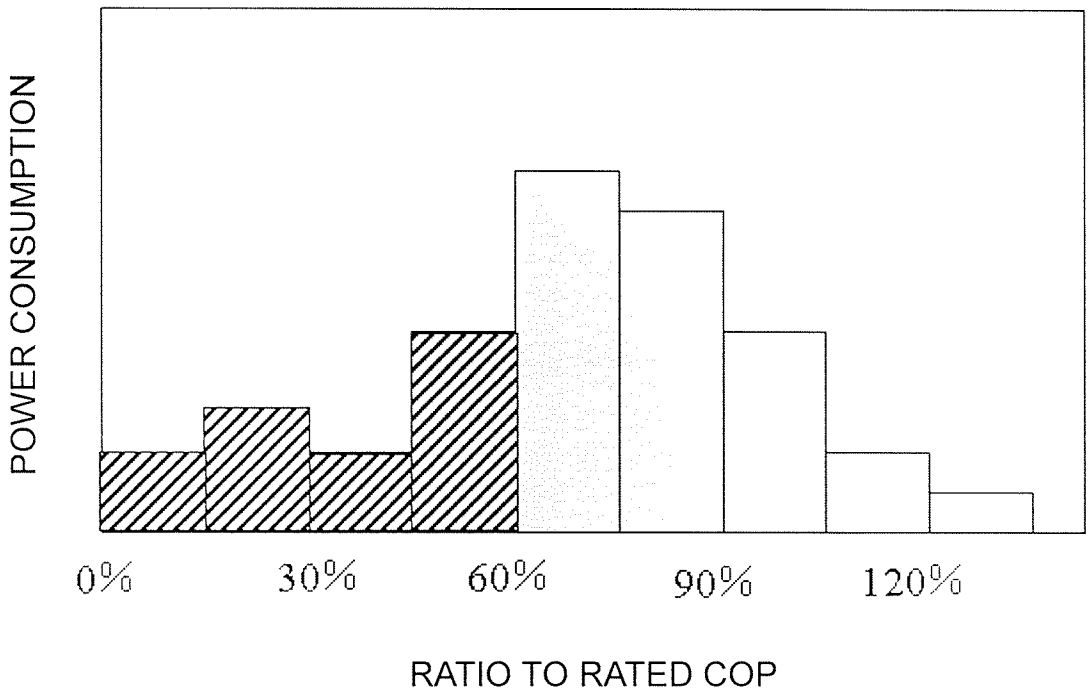
FIG. 10 is a chart representing the power consumption where the system COP is less than or equal to 60% of the rated COP.

Firstly in Step S201, the following condition 1 is determined. Simply put, it is determined whether a low COP operation is executed based on the state values specified in the aforementioned Step S102. In the present exemplary embodiment, a low COP refers to the state that the system COP is less than or equal to 60% of the rated COP, as described above. Therefore, it is herein determined whether or not operating time exists under the condition that the system COP is less than or equal to 60% of the rated COP. In FIG. 10, the power consumption is hatched with oblique lines when the system COP is less than or equal to 60% of the rated COP. The processing proceeds to Step S202 when it is determined that a low COP operation is executed in Step S201. On the other hand, the processing ends when it is determined that a low COP operation is not executed.

In Step S202, the following condition 2 is determined. Simply put, it is determined whether or not ratio of the power consumption under a low COP operation is greater than or equal to 20% of the total power consumption. Specifically, it is determined whether or not the portions hatched with oblique lines are greater than or equal to 20% of the total power consumption in FIG. 10. The processing proceeds to Step S203 when it is determined that the ratio of the power consumption under a low COP operation is greater than or equal to 20% of the total power consumption in Step S202. On the other hand, the processing ends when it is determined that the ratio of the power consumption under a low COP operation is less than 20% of the total power consumption in Step S202.

Figure 11:
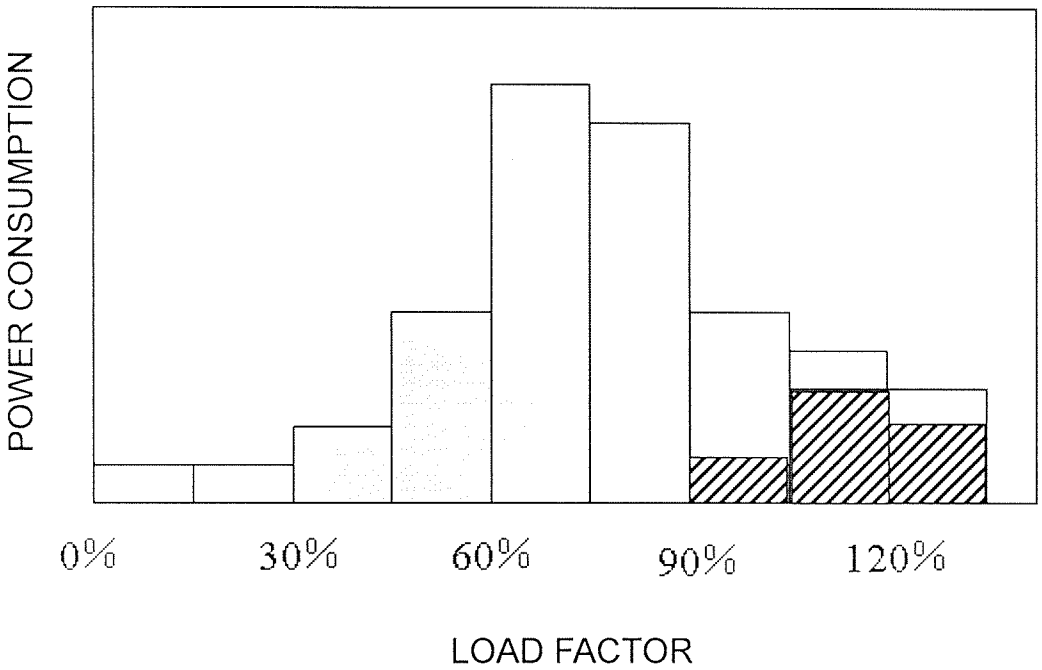
FIG. 11 is a chart representing a condition where a low COP operation is executed under a high load factor operation.

In Step S203, the following condition 3 is determined. Simply put, it is determined whether or not a low COP operation is executed under a high load factor (i.e., a load factor of greater than or equal to 90%) (premise 1), and it is determined further whether or not the power consumption under a high load factor and low COP operation (hereinafter referred to as "low COP and high load factor power consumption") is greater than or equal to 30% of the total power consumption under a low COP operation (hereinafter referred to as "low COP total power consumption") (premise 2). Specifically, the load determining section 35*f* determines in the premise 1 whether or not the power consumption under a low COP operation is included in the total power consumption when the load factor is greater than or equal to 90%, as hatched with oblique lines in FIG. 11. On the other hand, the operating efficiency determining section 35*g* determines in the premise 2 whether or not the low COP and high load factor power consumption hatched with oblique lines is greater than or equal to 30% of the low COP total power consumption. The processing proceeds to S204 when a low COP operation is executed under a high load factor operation and the low COP and high load factor power consumption is simultaneously greater than or equal to 30% of the low COP total power consumption as represented in FIG. 11. On the other hand, the processing proceeds to Step S205 either when a low COP operation is not executed under a high load factor or when a low COP operation is executed but the low COP and high load factor power consumption is less than 30% of the low COP total power consumption.

In Step S204, the measure information providing section 35*h* selects one of the plural measure information sets stored in the measure information storage area 34, which is associated with the condition 3 in the determination condition storage area 34*b*. Specifically, the measure information indicating "inhibition of the upper limit of the air conditioning performance" is selected. The measure information is provided to the screen generating section 35*j*, and the processing subsequently proceeds to Step S205.

Figure 12:
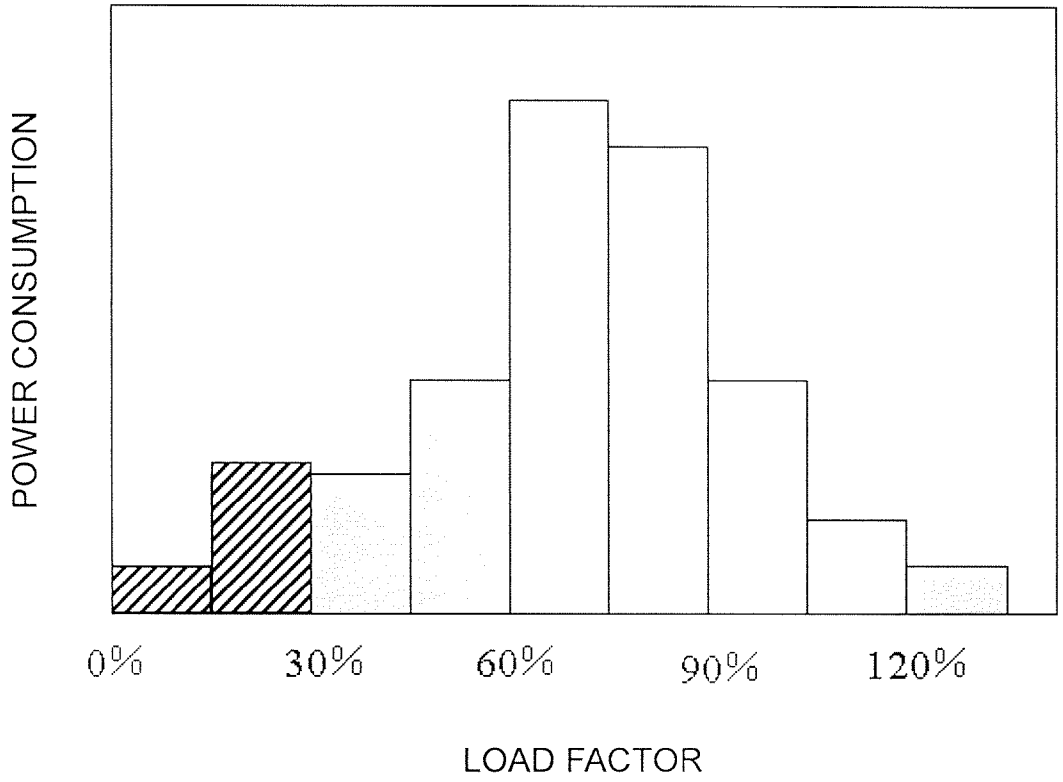
FIG. 12 is a chart illustrating a condition where a low COP operation is executed under a low load factor operation.

In Step S205, the following condition 4 is determined. Simply put, it is determined whether or not a low COP operation is executed under a low load factor (i.e., a load factor of less than or equal to 30%) operation (premise 1), and it is further determined whether or not the power consumption under a low load factor and low COP operation (hereinafter referred to as "low COP low and load factor power consumption") is greater than or equal to 30% of the low COP total power consumption (premise 2). In the premise 1, specifically, the load determining section 35*f* determines whether or not the power consumption under a low COP operation is included in the total power consumption when the load factor is less than or equal to 30%, as hatched with oblique lines in FIG. 12. In the premise 2, on the other hand, the operating efficiency determining section 35*g* determines whether or not the low COP and low load factor power consumption hatched with oblique lines is greater than or equal to 30% of the low COP total power consumption. The processing proceeds to Step S206 when a low COP operation is executed under a low load factor operation and the low COP and low load factor power consumption is simultaneously greater than or equal to 30% of the low COP total power consumption as represented in FIG. 12. On the other hand, the processing ends either when a low COP operation is not executed under a low load factor or when a low COP operation is executed but the low COP and low load factor power consumption is less than 30% of the low COP total power consumption.

In Step S206, the following condition 5 is determined. Simply put, it is determined whether or not the indoor units 12 are frequently activated and deactivated. It is herein determined that the indoor units 12 are frequently activated and deactivated when the indoor units 12 are activated and deactivated a predetermined number of times or more in an hour (i.e., five times or more in an hour in the present exemplary embodiment). The processing proceeds to Step S208 when it is determined that the indoor units 12 are frequently activated and deactivated in Step S206. On the other hand, the processing proceeds to Step S207 when it is not determined that the indoor unit 12 are frequently activated and deactivated in Step S206.

In Step S207, the following condition 6 is executed. Simply put, it is determined whether or not a continuous operating time T0 is relatively long. Specifically, it is determined whether or not the continuous operating time T0 is greater than or equal to T1 and less than T2. The processing proceeds to Step S208 when it is determined that the continuous operating time T0 is greater than or equal to T1 and less than T2 in Step S207.

In Step S208, the measure information providing section 35*h* selects one of the plural measure information sets stored in the measure information storage area 34*c*, which is associated with the conditions 5 and 6 in the determination condition storage area 34*b*. Specifically, the information indicating "temperature relief of heat exchangers" is selected. Temperature relief of heat exchangers herein refers to elevating of the evaporation temperature in a cooling operation and lowering of the condensation temperature in a heating operation. The single measure information set, selected by the measure information providing section 35*h*, is provided to the screen generating section 35*j*, and the processing subsequently ends.

On the other hand, the processing proceeds to Step S209 either when the continuous operating time T0 is greater than or equal to T1 but not less than T2 or when the continuous operating time T0 is less than T1 in Step S207. In Step 209, the following condition 7 is determined. Simply put, it is herein determined whether or not the continuous operating time T0 is greater than or equal to T2. The processing proceeds to Step S210 when it is determined that the continuous operating time T0 is greater than or equal to T2 in Step S209.

In Step S210, the measure information providing section 35*h* selects one of the plural measure information sets stored in the measure information storage area 34*c*, which is associated with the condition 7 in the determination condition storage area 34*b*. Specifically, the information indicating "intermittent operation" is selected. The intermittent operation herein refers to a forced thermo-off state of the air conditioner 10, for instance, for three minutes in a period of 30 minutes. Further, the forced thermo-off state refers to deactivation of a compressor of the outdoor unit 11. The single measure information, selected by the measure information providing section 35*h*, is provided to the screen generating section 35*j*, and the processing subsequently ends.

On the other hand, the processing ends without selecting the measure information set when the continuous operating time T0 is not greater than or equal to T2 in Step S209, i.e., the operating time T0 is less than T1 in Step S209.

<Features>

(1) In the diagnostic aid device 40 for the air conditioner according to the present exemplary embodiment, the respective results are displayed in the bar chart formats on the screens to be displayed on the display unit 32 (see FIG. 6A to FIG. 7). The magnitudes of the respective values are thereby visually recognizable and diagnosis of the operating efficiency of the air conditioner will be easy.

Further, the display unit 32 displays the total power consumption for the respective air conditioning load factors (see FIG. 6B) and the total power consumption for the respective system COPs (see FIG. 6D). Accordingly, it is possible to take into consideration of the power consumption in accordance with the magnitude of the system COP as well as the power consumption in accordance with the magnitude of the air conditioning load factor. Further, it is possible to find out an appropriate measure by determining the operating status of the air conditioner 10 from various perspectives. This results in achievement of an energy saving effect.

(2) Further, the bar chart, representing the relation between the system COP and the frequency, is displayed in the diagnostic aid device 40 of the present exemplary embodiment (see FIG. 6C). FIG. 6C indicates that frequency is relatively small where the system COP is low. Therefore, the bar chart indicates that the air conditioner 10 is not necessarily operated under an inefficient operation in terms of operation.

Yet further, the bar chart, representing the relation between the air conditioning load factor and the frequency, is displayed in the diagnostic aid device 40 (see FIG. 6A). It is possible to easily check how often COP reduction occurs due to reduction in the air conditioning load factor by comparing the aforementioned charts. For example, a relatively large frequency is observable under low air conditioning factors in FIG. 6A, whereas a large frequency is not observable under extremely low COPs in FIG. 6C. In general, the system COP shows a downward trend under a low air conditioning load factor. It is therefore important to check occurrence of partial load that COP becomes lower when the COP is assessed for an energy saving purpose.

(3) Further, it is possible to diagnose the relation between the frequency regarding a predetermined air conditioning load factor and the total power consumption by comparing the screen represented in FIGS. 6A and 6B. Specifically, it is possible to easily determine how much the power consumption is savable by stopping operations in a situation of a low load factor.

Yet further, it is possible to diagnose the relation between the frequency regarding a predetermined system COP and the total power consumption by comparing the screens represented in FIGS. 6C and 6D. Specifically, it is possible to easily determine how much the power consumption is savable by stopping operations in a situation of a low system COP.

(4) Moreover, the operating efficiency is determined based on the operating status of the air conditioner 10 in the diagnostic aid device 40 of the present exemplary embodiment. Further, a measure aimed at improvement of the operating efficiency is configured to be displayed on the screen when the operating efficiency is herein determined to be inefficient. Therefore, an administrator can easily grasp what kind of measure should be done for enhancing the operating efficiency of the air conditioner 10.

<Exemplary Modifications>

(1) The diagnostic aid device 40 of the aforementioned exemplary embodiment is formed by the controller 20 and the auxiliary device 30. However, the diagnostic aid device 40 may be a single device having functions of the controller 20 and the auxiliary device 30. Alternatively, either or both of the controller 20 and the auxiliary device 30 may be provided with the functions of both the controller 20 and the auxiliary device 30.

(2) The display unit 32 may be designed to separately display the bar charts by switching the screens back and forth. Alternatively, the display unit 32 may be designed to simultaneously display a plurality of bar charts representing respective states on a single screen.

Figure 13:
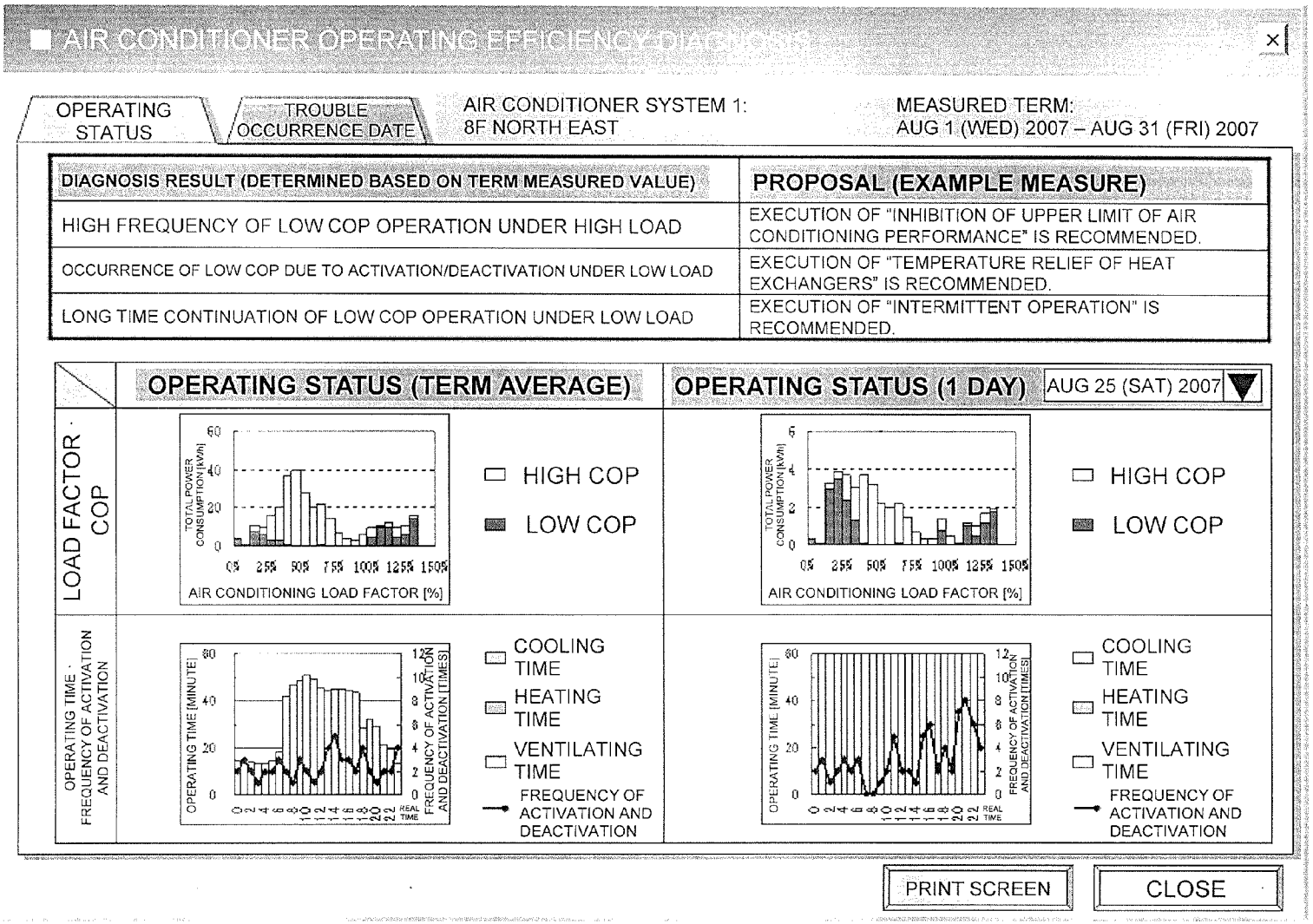
FIG. 13 is an exemplary operating efficiency diagnosis screen according to Modification (3).

(3) In FIG. 7 used for the aforementioned exemplary embodiment, a type of the diagnostic screen is exemplified that both of the following bar charts are selected from the screens generated by the screen generating section 35*j* and displayed side-by-side: the bar charts where the horizontal axis represents the air conditioning load factor and the vertical axis represents the total power consumption; and the bar chart where the horizontal axis represents that system COP and the vertical axis represents the total power consumption. However, bar charts represented in FIG. 13 may be used instead of the bar charts used in FIG. 7. In the bar charts of FIG. 13, the horizontal axis represents the air conditioning load factor whereas the vertical axis represents the total power consumption. Further, the high COP and the low COP are distinguishable from each other by painting bars of the bar charts with predetermined colors. It is thereby possible to grasp a plurality of state values using a single bar chart.

Figure 14:
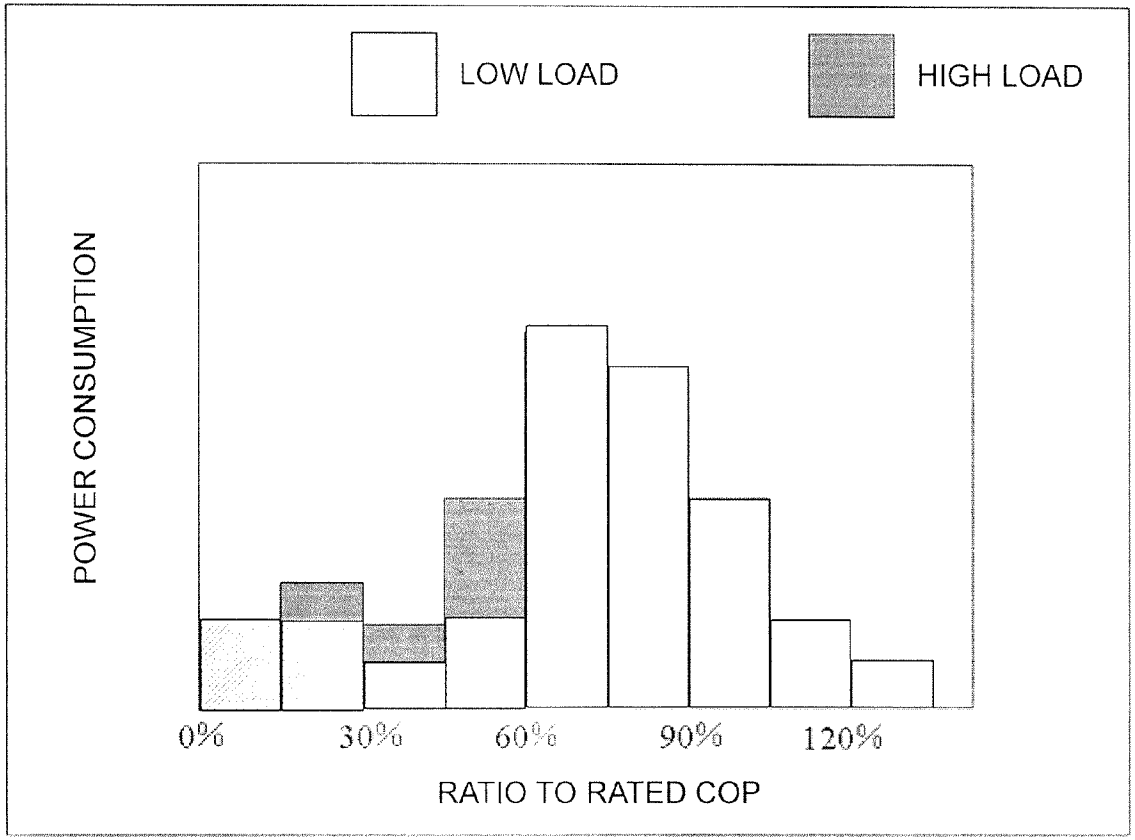
FIG. 14 is a bar chart according to Modification (4).

(4) The display unit 32 of the auxiliary device 30 may be configured to display the bar chart (FIG. 10) used for explaining the operating efficiency determination processing in the aforementioned exemplary embodiment. In FIG. 10, the vertical axis represents the power consumption whereas the horizontal axis represents the rated COP. However, a bar chart represented in FIG. 14 may be displayed instead of FIG. 10. FIG. 14 represents not only the power consumption and the rated COP but also under which operations the air conditioner 10 is operated either a low load operation or a high load operation. It is thereby possible to grasp the power consumption, the rated COP and load levels (i.e., low load and high load) using a single bar chart.

Figure 15:
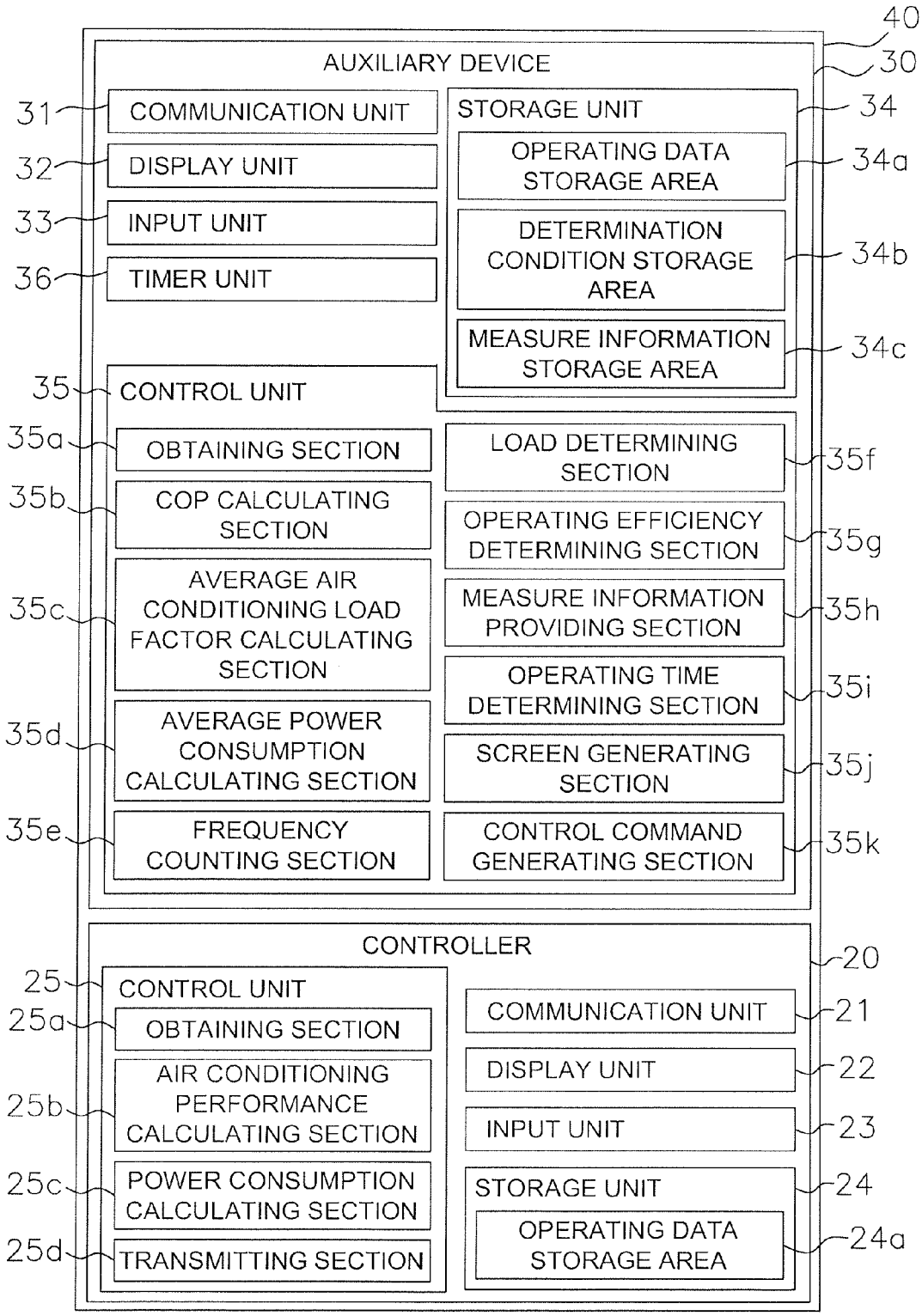
FIG. 15 is a diagram illustrating a diagnostic aid device 40 according to Modification (5).

(5) As illustrated in FIG. 15, the control unit 35 of the auxiliary device 30 of the aforementioned exemplary embodiment may further include a control command generating section 35*k*. The control command generating section 35*k* is configured to generate a control command based on the measure information set selected by the measure information providing section 35*h*. The control command is configured to be transmitted to the air conditioner 10 through the controller 20. Accordingly, a control command is transmitted to the air conditioner 10 in accordance with the operating efficiency determined by the operating efficiency determining section 35*g* in order to improve the operating efficiency. It is thereby possible to cause the air conditioner 10 to automatically execute a control for improving the operating efficiency when the operating efficiency is inefficient.

(6) In the aforementioned exemplary modifications, FIGS. 10 to 12 are represented where the vertical axes represent the power consumption. However, the vertical axes may represent the frequency.

(7) The aforementioned exemplary embodiment exemplifies a case that a predetermined term is set as "one day". However, the predetermined term may be shorter or longer than one day. For example, the predetermined term may be an hour or a minute. Alternatively, the predetermined term may be a month or a year.

Other Exemplary Embodiment

The present exemplary embodiment of the present invention has been described above with reference to the figures. However, the specific configuration of the present invention is not limited to the aforementioned exemplary embodiment and a variety of changes can be made for the configuration without departing from the scope of the present invention.

INDUSTRIAL APPLICABILITY

The present invention is useful as a diagnostic aid device for easily diagnosing an operating efficiency of an air conditioner.

What is claimed is:

1. A diagnostic aid device configured to aid diagnosis of an operating efficiency of an air conditioner, the diagnostic aid device comprising:

a communication unit connected to the air conditioner, the communication unit being configured to transmit a control command for the air conditioner and obtain operating data of the air conditioner;

an obtaining section connected directly or indirectly to the communication unit, the obtaining section being configured to obtain the operating data;

a specifying section configured to specify a state value of the air conditioner using the operating data obtained by the obtaining section, the state value including air conditioning load factor, COP, power consumption or frequency; and a screen generating section configured to generate either a first screen or a second screen based on the state value specified by the specifying section, the first screen representing an operating status of the air conditioner, and the second screen representing the operating status and single or plural sets of information related to a measure used to improve the state value.

2. The diagnostic aid device recited in claim 1, further comprising:

a determining section configured to determine the operating efficiency based on the state value; and a measure information providing section configured to provide the screen generating section with the single or plural sets of information, the measure information providing section being further configured to provide the screen generating section with the single or plural sets of information based on the operating efficiency determined by the determining section.

3. The diagnostic aid device recited in claim 2, further comp sing:

a determination condition storage area configured to store conditions used by the determining section to determine the operating efficiency; and a measure information storage area configured to store plural sets of information in accordance with the operating efficiency determined by the determining section.

4. The diagnostic aid device recited in claim 3, wherein the measure information providing section is further configured, when the operating efficiency determined by the determining section is in a first state, to select one of the plural sets of information stored in the measure information storage area, and to provide the selected set of information to the screen generating section, and the screen generating section is further configured to generate the second screen including the operating status of the air conditioner and the set of information provided thereto from the measure information providing section.

5. The diagnostic aid device recited in claim 4, wherein the measure information providing section is further configured, when the determining section determines that the operating efficiency is below a prescribed efficiency, to select a predetermined one of the plural sets of information, and to provide the selected set of information to the screen generating section.

6. The diagnostic aid device recited in claim 5, wherein the measure information providing section is further configured to select the predetermined one of the plural sets of information in a case that the operating efficiency is below the prescribed efficiency, the case including both of a situation that the COP is low and a situation that the power consumption is large.

7. The diagnostic aid device recited in claim 6, further comprising:

a load determining section configured to determine when the low COP situation occurs when the air conditioner is under a high load or when the air conditioner is under a low load, the measure information providing section being further configured, when the operating efficiency is below the prescribed efficiency, to select one of the plural sets of information in accordance with a result determined by the load determining section, and to provide the selected set of information to the screen generating section.

8. The diagnostic aid device recited in claim 7, further comprising:

an operating time determining section configured to determine an operating time of the air conditioner based on the state value, the measure information providing section being further configured to select one of the plural sets of information in accordance with a result determined by the operating time determining section, and to provide the selected set of information to the screen providing section.

9. The diagnostic aid device recited in one of claim 3, wherein the plural sets of information are proposals indicating air conditioning performance inhibition, target temperature change or intermittent operation execution, respectively.

10. The diagnostic aid device recited in claim 4, further comprising:

a control command generating section configured to generate a control command used to control the air conditioner in accordance with the set of information selected by the measure information providing section.

11. The diagnostic aid device recited in claim 1, wherein the screen generating section is further configured to generate either the first screen or the second screen in order to display the operating status determined based on a relation between a prescribed single state value and each of the other plural state values.

12. The diagnostic aid device recited in claim 11, wherein the first screen or the second screen generated by the screen generating section includes a third screen and a fourth screen, the third screen is configured to display an operating status determined based on a relation between a first state value corresponding to the prescribed single state value and a second state value different from the first state value, and the fourth screen is configured to display an operating status determined based on a relation between the first state value and a third state value different from both of the first state value and the second state value.

13. The diagnostic aid device recited in claim 12, wherein the operating status is displayed on each of the third screen and the fourth screen in a bar chart format.

14. The diagnostic aid device recited in claim 12, wherein the first state value indicates the air conditioning load factor, the second state value indicates the frequency, and the third state value indicates the power consumption.

15. The diagnostic aid device recited in claim 12, wherein the first state value indicates the COP, the second state value indicates the frequency, and the third state value indicates the power consumption.

16. A diagnostic aid device configured to aid diagnosis of an operating efficiency of an air conditioner, the diagnostic aide device comprising:

a controller connected to the air conditioner, the controller being configured to transmit a control command for the air conditioner and obtain operating data of the air conditioner; and an auxiliary device connected to the controller, the controller including an obtaining section configured to obtain an operating data of the air conditioner, and a specifying section configured to specify a first state value of the air conditioner using the operating data obtained by the obtaining section of the controller, the first state value including air conditioning load factor, or power consumption, the auxiliary device including an obtaining section configured to obtain an operating data of the air conditioner, a specifying section configured to specify a second state value of the air conditioner using the operating data obtained by the obtaining section of the auxiliary device, the second state value including air conditioning load factor, COP, power consumption or frequency, and a screen generating section configured to generate either a first screen or a second screen based on the first state value or the second state value, the first screen representing an operating status of the air conditioner, and the second screen representing the operating status and single or plural sets of information related to a measure used to improve the state value.

17. The diagnostic aid device recited in claim 16, wherein the auxiliary device further includes a determining section configured to determine the operating efficiency based on the second state value corresponding to the COP and the power consumption, a load determining section configured to determine when the low COP situation occurs when the air conditioner is under a high load or when the air conditioner is under a low load, and a measure information providing section configured when the determining section determines that the operating efficiency is below a prescribed efficiency, to provide the screen generating section with a single or plural sets of information in accordance with a result determined by the load determining section.

* * * * *